US009175888B2

(12) United States Patent
Boarman

(10) Patent No.: US 9,175,888 B2
(45) Date of Patent: Nov. 3, 2015

(54) LOW ENERGY REFRIGERATOR HEAT SOURCE

(71) Applicant: Whirlpool Corporation, Benton Harbor, MI (US)

(72) Inventor: Patrick J. Boarman, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 238 days.

(21) Appl. No.: 13/691,890

(22) Filed: Dec. 3, 2012

(65) Prior Publication Data

US 2014/0150484 A1 Jun. 5, 2014

(51) Int. Cl.

| | |
|---|---|
| ***F25B 27/00*** | (2006.01) |
| ***F25C 1/24*** | (2006.01) |
| ***F25C 5/00*** | (2006.01) |
| ***F25C 5/08*** | (2006.01) |
| ***F25D 21/12*** | (2006.01) |

(52) U.S. Cl.

CPC . *F25B 27/00* (2013.01); *F25C 1/24* (2013.01); *F25C 5/005* (2013.01); *F25C 5/08* (2013.01); *F25D 21/12* (2013.01)

(58) Field of Classification Search

CPC ..... F25B 27/00; F25C 5/005; F25C 5/08; F25C 1/24; F25D 21/12

USPC ..... 62/238.1, 238.6, 79, 349, 441, 447

See application file for complete search history.

(56) References Cited

U.S. PATENT DOCUMENTS

| | | | | | |
|---|---|---|---|---|---|
| 3,548,923 | A | * | 12/1970 | Kunihiko et al. | 165/236 |
| 4,488,408 | A | * | 12/1984 | Kajitsuka | 62/113 |
| 4,739,629 | A | * | 4/1988 | True | 62/338 |
| 5,372,014 | A | | 12/1994 | Adams | |
| 5,666,817 | A | | 9/1997 | Schulak | |
| 5,818,131 | A | * | 10/1998 | Zhang | 310/15 |
| 5,845,507 | A | * | 12/1998 | Critoph et al. | 62/106 |
| 5,964,101 | A | | 10/1999 | Schulak | |
| 6,230,514 | B1 | | 5/2001 | Schulak | |
| 6,293,107 | B1 | | 9/2001 | Kitagawa | |
| 6,327,871 | B1 | | 12/2001 | Rafalovich | |
| 6,463,755 | B2 | | 10/2002 | Schulak | |
| 6,735,959 | B1 | | 5/2004 | Najewicz | |
| 7,434,417 | B2 | * | 10/2008 | Lee | 62/353 |

(Continued)

FOREIGN PATENT DOCUMENTS

| | | | |
|---|---|---|---|
| CN | 2757045 | Y | 2/2006 |
| DE | 102010001465 | A1 | 8/2011 |

(Continued)

OTHER PUBLICATIONS

EP Search Opinion, EP2738483, Dated Feb. 2, 2015.

(Continued)

*Primary Examiner* — Mohammad M Ali

(57) ABSTRACT

A refrigerator is provided that includes a low energy refrigerator heat source. The refrigerator includes a heat source positioned at a source of latent heat. The heat source harvested heat from the source of latent heat and stores said heat in a fluid within that heat reservoir or heat exchanger. The warmed fluid is then supplied via a fluid pathway to an application requiring a heat output. Thus, the heat reservoir provides heat to the application without use of an energy-consuming device, which reduces the energy consumption of the refrigerator.

20 Claims, 6 Drawing Sheets

(56) References Cited

U.S. PATENT DOCUMENTS

| | | | | |
|---|---|---|---|---|
| 7,610,773 | B2 | 11/2009 | Rafalovich | |
| 7,762,101 | B1 | 7/2010 | Zuili | |
| 7,850,898 | B1 * | 12/2010 | Rowley et al. | 264/514 |
| 8,099,975 | B2 | 1/2012 | Rafalovich | |
| 2004/0079106 | A1 * | 4/2004 | Maier-Laxhuber et al. | 62/480 |
| 2006/0168983 | A1 | 8/2006 | Tatsui | |
| 2006/0260325 | A1 | 11/2006 | Lin | |
| 2006/0260350 | A1 | 11/2006 | Van Meter | |
| 2007/0180839 | A1 | 8/2007 | Kim | |
| 2007/0261431 | A1 | 11/2007 | Cohen | |
| 2008/0141699 | A1 | 6/2008 | Rafalovich | |
| 2008/0196429 | A1 * | 8/2008 | Petrenko et al. | 62/207 |
| 2009/0133409 | A1 | 5/2009 | Chen | |
| 2009/0151375 | A1 | 6/2009 | Tarr | |
| 2009/0282844 | A1 | 11/2009 | Rafalovich | |
| 2010/0101263 | A1 * | 4/2010 | Lee et al. | 62/407 |
| 2010/0126185 | A1 | 5/2010 | Cho | |
| 2010/0242530 | A1 | 9/2010 | Tindale | |
| 2011/0094256 | A1 | 4/2011 | Song | |
| 2011/0219794 | A1 | 9/2011 | Shiba | |
| 2011/0308259 | A1 | 12/2011 | Wray | |
| 2012/0031129 | A9 | 2/2012 | Tarr | |
| 2012/0055191 | A1 | 3/2012 | Lee | |
| 2012/0167596 | A1 | 7/2012 | Krause | |

FOREIGN PATENT DOCUMENTS

| | | | |
|---|---|---|---|
| DE | 102010042080 | A1 | 4/2012 |
| EP | 0171140 | A2 | 12/1986 |
| EP | 1821051 | A1 | 8/2007 |
| EP | 2444761 | A2 | 4/2012 |
| GB | 839337 | | 6/1960 |
| GB | 2453515 | A | 4/2009 |
| JP | 11023135 | A | 1/1999 |
| JP | 2000121218 | A | 4/2000 |
| JP | 2007255804 | A | 10/2001 |
| JP | 2003227673 | A | 8/2003 |
| JP | 2007255804 | A | 10/2007 |
| KR | 100627911 | B1 | 9/2009 |

OTHER PUBLICATIONS

EP Search Opinion, EP2738484, Dated Feb. 23, 2015.

EP Search Opinion, EP2738485, Dated Feb. 2, 2015.

EP Search Opinion, EP2738496, Dated Feb. 2, 2015.

EP Search Opinion, EP2738497, Dated Feb. 2, 2015.

Vian, J. et. al, "Development of a Thermoelectric Ice Maker of Fingers Incorporated into a Static Domestic Refrigerator", 5th European Conference on Thermoelectrics, Sep. 10, 2007, pp. 1-6.

* cited by examiner

LOW ENERGY REFRIGERATOR HEAT SOURCE

FIELD OF THE INVENTION

The disclosure relates generally to refrigerators. More particularly, but not exclusively, the disclosure relates to a refrigerator utilizing latent heat to provide heat to applications having a heat output.

BACKGROUND OF THE INVENTION

Bottom mount refrigerators include a freezer compartment on the bottom, with the fresh food or refrigerator compartment above the freezer compartment. One or more doors provide access to the refrigerator compartment, and a separate door provides access to the freezer compartment. The freezer door or doors may be drawer-type doors that are pulled out, or they may be hingedly connected similar to the refrigerator compartment doors, such that they are rotated to provide access within.

Many applications of the refrigerator require a heat output. For example, electrically generated heat is used to defrost evaporator coils, to prevent or minimize sweating door or sidewall panels, to prevent fill tubes from freezing, to aid in the harvesting of ice cubes from molds, to warm storage areas, and to warm compartments, shelves, drawers, or the like for accelerated food defrost. Other applications may also use electrically generated heat.

As the cost of energy increases, consumers have demanded low energy appliances to try to keep their bills at a minimum. Therefore, there is a need in the art for a low energy solution to provide heat to the various locations and applications for an appliance, such as a refrigerator.

SUMMARY OF THE INVENTION

Therefore, one aspect of the disclosure is to provide an apparatus that overcomes the deficiencies in the art.

Another aspect of the disclosure is to provide a refrigerator that utilizes a latent heat store to provide heat to various refrigerator applications.

Another aspect of the disclosure is to provide a method for utilizing latent heat in refrigerator applications.

Still another aspect of the disclosure is to provide a refrigerator with a low energy solution for providing heat to a refrigerator application that might otherwise be electrically heated.

Another aspect of the disclosure is to provide a refrigerator that can store latent heat for use in a refrigerator.

These and/or other objects, features, and advantages of the disclosure will be apparent to those skilled in the art. The disclosure is not to be limited to or by the above-described aspects. No single embodiment need provide each and every aspect of the disclosure.

According to an aspect of the disclosure, a refrigerator is provided. The refrigerator includes a cabinet body and a door that provides access to the cabinet body. A heat reservoir may be positioned at a source of latent heat, with the heat reservoir harvesting heat from the source of latent heat. The heat storage may be a heat storage battery or a heat exchanger. The refrigerator also may include an application having a heat output. The application may be at a location generally remote from the heat reservoir. The application may be an icemaker, a defrost operation, an anti-condensation operation, an anti-freezing operation, or a storage space. A fluid pathway may be positioned between the heat reservoir and the application for supplying heat at the application from the heat reservoir. A pump may be in operable communication with the fluid pathway for moving fluid through the fluid pathway between the heat reservoir and the application.

According to another aspect of the disclosure, a refrigerator is provided. The refrigerator includes a cabinet body and a door that provides access to the cabinet body and an application having a heat output associated with an operation of the refrigerator. A flow pathway is positioned at a source of latent heat. The flow pathway is configured between the source of latent heat and the application for supplying the heat output for the operation from the source of latent heat. A pump is configured in operable communication with the flow pathway for moving the latent heat through the flow pathway between the source of latent heat and the application. A heat exchanger and fluid supply line may also be included with the refrigerator.

According to another aspect of the disclosure, a method for using latent heat in a refrigerator is provided. The method includes positioning a heat exchanger at a source of latent heat. Heat is harvested from the source of latent heat with a fluid. The fluid is communicated to an application having a heat output. The heat output is supplied at the application using the latent heat in the fluid. The method may also include pumping the fluid from the heat exchanger to the application through a fluid supply line.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1:
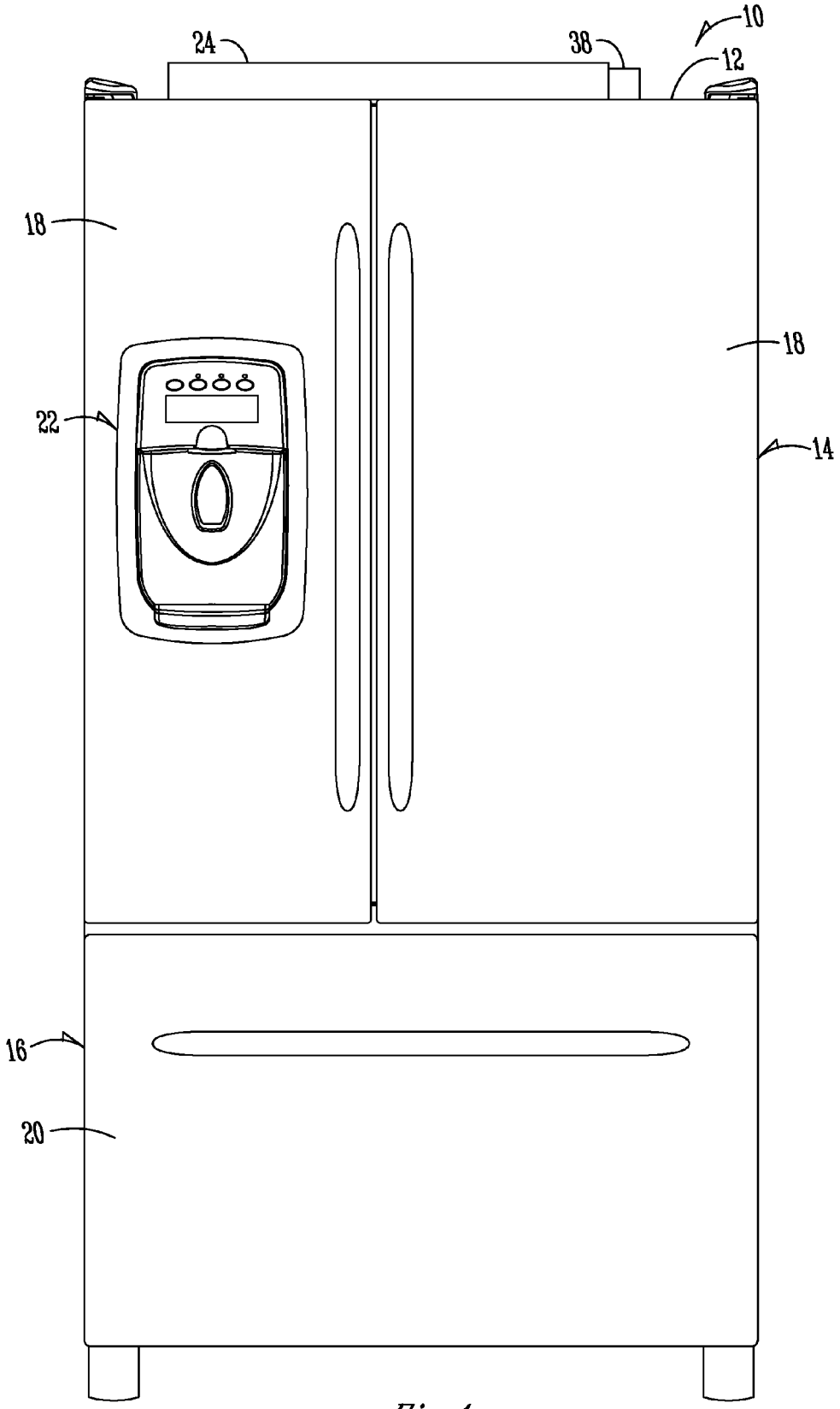
FIG. 1 is a front elevation view of a bottom mount refrigerator.

FIG. 1 is a front elevation view of a bottom mount refrigerator 10. The bottom mount refrigerator 10 includes a cabinet 12 with one or more compartments. As shown in FIG. 1, the upper compartment is a refrigerator or fresh food compartment 14. Doors 18 provide access to the interior of the refrigerator compartment 14. The doors 18 are hingedly attached to the cabinet 12. A dispenser 22 is shown to be positioned on one of the doors 18 of the refrigerator compartment 14. The dispenser 22 may be a water dispenser, ice dispenser, other beverage dispenser, or some combination thereof. Furthermore, the dispenser may be placed on any door of the refrigerator 10, or the dispenser 22 may be placed within one of the compartments of the refrigerator 10. For example, the dispenser 22 may be placed at one of the interior walls of the refrigerator compartment 14, thus being part of the cabinet 12. The placement of the dispenser 22 is not to be limited. Positioned generally below the refrigerator compartment 14 is a freezer compartment 18. A freezer door 20 provides access to within the freezer compartment 18. The freezer door 20 of FIG. 1 is shown to be a drawer-type door; however, the disclosure contemplates that the freezer door may be a drawer, a hinged door, multiple doors, or some combination thereof.

It should also be appreciated that, while the figures show a bottom mount-style refrigerator 10, the disclosure contemplates that any style of a refrigerator be included as part of the invention. The figures merely depict one example of a type of refrigerator 10 that exemplary aspects of the disclosure can be used with.

Figure 2:
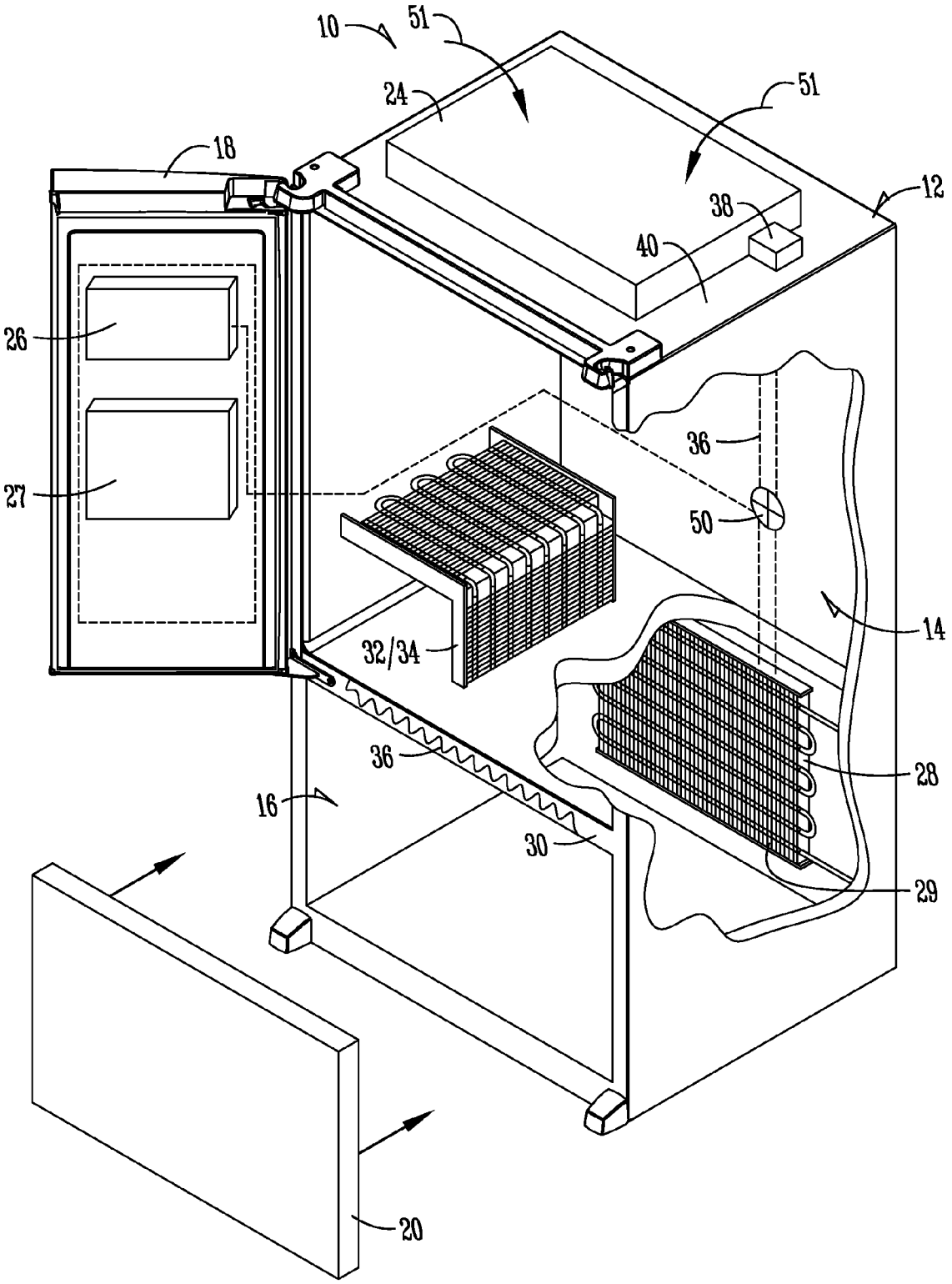
FIG. 2 is a partial sectional perspective view of the refrigerator of FIG. 1 according to an exemplary aspect of the disclosure.

Also shown in FIG. 1 and positioned generally at an exterior surface 40 of the refrigerator 10 is a heat reservoir 24. The heat reservoir 24 is shown to be positioned on top of the cabinet 12 of the refrigerator 10. However, it should be appreciated that the heat reservoir 24 may be positioned at generally any exterior surface or interior location of the refrigerator 10. The heat reservoir 24 is configured to harvest and/or store latent heat from the ambient air around the refrigerator 10, or from a component of the refrigerator cycle. For example, as is discussed below, the heat reservoir 24 may acquire latent heat from off of a condenser 46 (FIG. 2). The heat reservoir 24 may comprise a heat storage battery, heat exchanger, or a combination thereof. For example, the heat reservoir 24 may comprise a container containing a fluid, such as water, glycol, or another liquid. The heat reservoir 24 is configured to harvest and store the fluid at a temperature generally greater than the freezing temperature (32° F.). Thus, the heat reservoir 24 may be configured generally of a material that is able to maintain and store a fluid or other heat carrier at the desired temperature range. For example, the heat reservoir 24 may comprise a phase change material (hereinafter PCM) that has a higher freezing temperature than that of water. Thus, the PCM of the heat reservoir 24 will not freeze in normal operating conditions.

Additionally shown in FIG. 1 is a pump 38 positioned adjacent the heat reservoir 24. The pump 38 is operatively connected to the heat reservoir 24 and is configured to pump the fluid material of the heat reservoir to various locations of the refrigerator 10 in order to provide the warmer temperature fluid to an application of the refrigerator 10 requiring such higher temperature fluid. For example, certain applications of a refrigerator 10 require a heat output. However, these applications may be located remote of the heat reservoir 24. Examples of such applications utilizing a heat output may include, but are not limited to, a defrost operation such as defrosting the evaporator coils, where the heat output is used to defrost the coils, an ice maker having an ice mold with a heat output used to help separate the formed ice cubes from the mold, an anti-condensation operation with the heat output used to aid in limiting or preventing sweat or fluid occurring on some exterior surface of the refrigerator, an anti-freezing operation such that the heat operation prevents a device such as a fill tube from freezing during normal operation of the refrigerator, or a storage space having a warming operation such that the heat output maintains the temperature in the storage space at a temperature to prevent freezing or to provide accelerated defrost for a consumable item. Other applications obvious to those skilled in the art that may benefit from receiving a heat output may also be included as part of the disclosure. The above-identified applications are for exemplary purposes, and are not to limit the disclosure.

FIG. 2 is a partial sectional perspective view of the refrigerator 10 shown in FIG. 1 according to an exemplary embodiment of the disclosure. FIG. 2 shows the refrigerator 10 with the refrigerator door 16 removed, the refrigerator door 18 open, the freezer door 20 positioned generally away from the freezer compartment 18, and with a portion of the refrigerator cabinet 12 removed such that the inside of the refrigerator 10 may be viewed. FIG. 2 also shows the location of some of the applications described above that may utilize a heat output during operation. For example, FIG. 2 shows an icemaker 26 and ice storage bin 27 positioned on the interior of the refrigerator compartment door 18. However, it should be appreciated that the icemaker 26 and/or ice storage bin 27 may also be positioned at an interior of the refrigerator compartment 14, such as at the top wall or sidewall thereof. FIG. 2 also shows the position of an evaporator 28 including evaporator coils 29 that are used in the refrigerator cycle to provide cooled air for the refrigerator 14 and/or freezer compartment 18. The location of the evaporator 28 may vary according to refrigerator 10. Also shown in FIG. 2 is a mullion 30 separating the refrigerator compartment 14 and a freezer compartment 18, and a warm storage compartment 32, which also may be known as a defrost compartment 34. As discussed above, the warm storage and/or defrost compartment 32/34 may be used to provide an area within the cabinet 12 that is at a higher temperature than the rest of the compartment. While the figures show the warm storage compartment 32 positioned in the refrigerator compartment 14 as a drawer or separate compartment, it should be appreciated that the warm storage compartment 32 and/or defrost compartment 34 may also be a bin, shelf, drawer and/or other compartment or area within the refrigerator, and is not limited to the configuration shown in the figures.

The heat reservoir 24 can be positioned on an exterior 40 of the refrigerator cabinet 12. In FIG. 2, the heat reservoir 24 is positioned on the top of the refrigerator cabinet 12. Ambient air, which is at a temperature generally greater than the freezer compartment air (e.g., temperatures near or below 0° Fahrenheit) and the refrigerator compartment air (e.g., temperatures generally between 35° Fahrenheit and about 40° Fahrenheit), includes latent heat, which may be harvested by the heat reservoir. This is shown by the arrows 51 in FIG. 2. For example, the latent heat of the ambient air may be absorbed by the heat reservoir due to the temperature and/or composition of the fluid within the heat reservoir 24. As discussed, the fluid within the heat reservoir 24 may be glycol or another anti-freeze or PCM, or it may be water. Thus, the latent heat 51 of the ambient air may be absorbed into the fluid to increase the temperature of said fluid. The pump 38 is operatively attached to the heat reservoir 24 and also to one or a plurality of fluid pathways or flow pathways 36. The fluid or flow pathways 36 are operatively connected to the heat reservoir 24, pump 38 and location of the applications requiring the heat output. For example, one such fluid pathway 36 may extend from the heat reservoir 24 to the ice maker 26 such that when ice has been formed in the ice mold 42 of the ice maker 26, the warm fluid of the heat reservoir 24 is directed by the pump 38 to the ice mold 42 to aid in dislodging the formed ice from the mold 42. Other pathways 36 may direct the fluid of the heat reservoir 24 to other applications, such as the evaporator 28 or warm storage compartment 32. In addition, the pathways may include flow controllers 50 (e.g., dampers or baffles), which may aid in directing the fluid from the heat reservoir 24 to the application requiring the heat output.

Furthermore, while the foregoing has described the movement of the actual fluid within the heat reservoir 24, it is contemplated that the heat reservoir 24 comprises a PCM or other heat exchange. In such a case, a fluid may only need to pass through the heat reservoir 24 in order to absorb heat from the PCM or heat exchanger within the heat reservoir, thus raising the temperature of the passing fluid. Therefore, the setup would eliminate the need for a fluid storage, as the pathways 36 may simply pass through the heat exchanger/PCM of the heat reservoir 24. Such a configuration would be akin to the refrigerant passing through the refrigeration cycle to provide cooled air for the refrigerator compartments.

Figure 3:
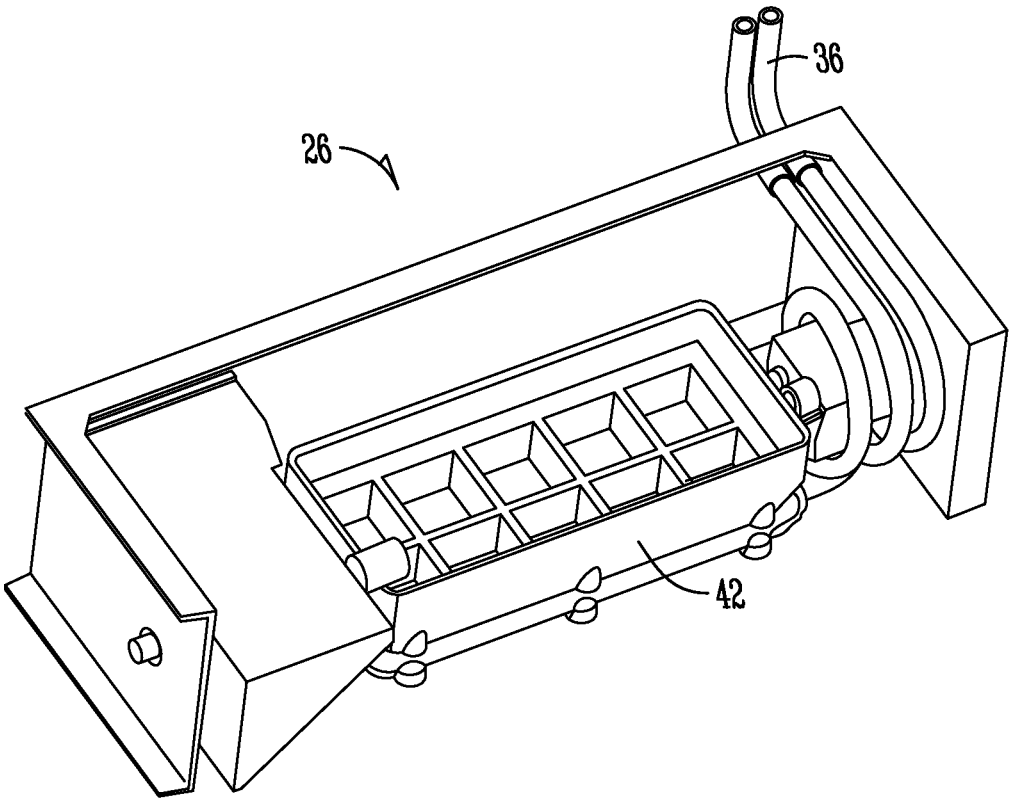
FIG. 3 is a perspective view of an icemaker for use with a refrigerator.

FIG. 3 is a perspective view of an icemaker 26 including an ice mold 42 for use with a refrigerator 10. In operation, water is added to the ice mold 42 of the icemaker 26. Heat is removed from the water to cool the water to form ice in the mold. However, to aid in dislodging the formed ice in the ice mold 42 to dispense said formed ice into an ice bin 27, a heat output may be used or passed through the ice mold to melt a portion of the ice in contact with the mold 42. This dislodges the formed ice from the ice mold to allow the icemaker 26 to dispense the ice to the ice bin 27. Therefore, a fluid pathway 36 may extend from the heat reservoir 24 into the ice mold 42. An intelligent control 200 (shown in FIG. 6), such as a circuit or computer, may indicate to the pump 38 adjacent the heat reservoir 24 that heat output is required or needed at the ice mold 42. Thus, the pump 38 will begin to pump the warmed fluid of the heat reservoir 24 through the fluid pathway 36 toward the ice mold 42. Flow controllers 50 may be configured along said fluid pathway 36 to bypass other applications in the refrigerator to direct the fluid of the heat reservoir to the ice mold 42. The warmed fluid of the heat reservoir 24 passes adjacent a portion of the ice mold 42 to partially melt a portion of the formed ice in the ice mold 42. The icemaker 26 may then dispense the formed ice from the ice mold 42 to an ice storage bin 27. The warming fluid is then returned to the heat reservoir 24 to be re-warmed by the latent heat of ambient air 51 or of a refrigeration cycle 52 to be re-warmed for reuse.

Therefore, as the fluid of the heat reservoir 24 will be passing temperatures at or near freezing, it may be preferred to use an anti-freeze, such as glycol, such that the fluid will not freeze when passing by said freezing or near freezing temperatures. However, as the fluid is generally passed rather quickly by the application at or near freezing, water may also be used as the warming fluid.

Figure 4:
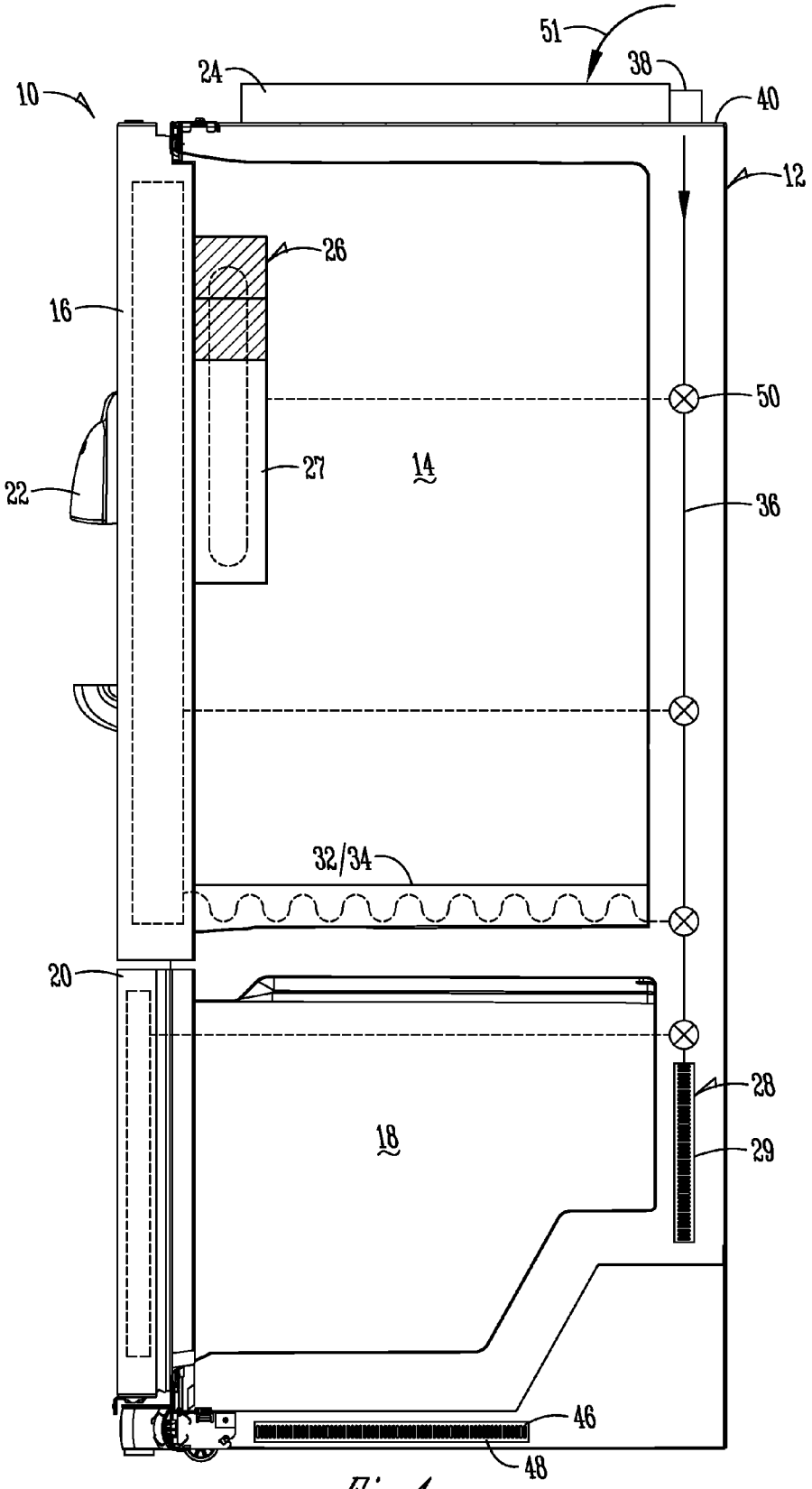
FIG. 4 is a sectional side view of a refrigerator according to another aspect of the disclosure.
Figure 5:
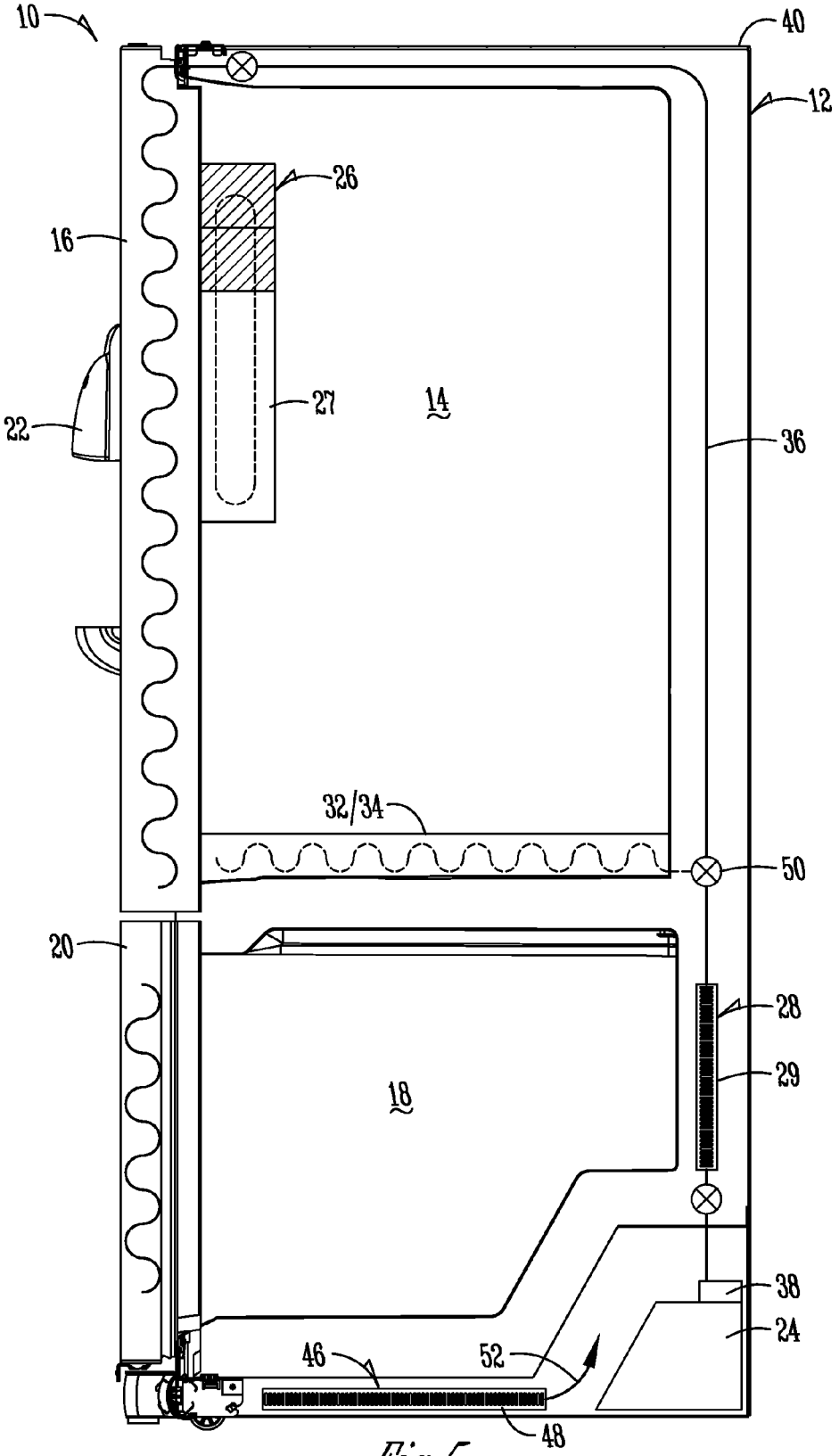
FIG. 5 is a sectional side view of a refrigerator according to another embodiment.

FIGS. 4 and 5 are sectional side views of refrigerator 10 according to exemplary embodiments of the disclosure. FIG. 4 shows the refrigerator 10 with a heat reservoir 24 on an exterior surface 40, which is the top of the cabinet 12. However, as mentioned above, the heat reservoir 24 may be positioned generally at any exterior surface of the cabinet 12, including the sides, or the rear or back surface of the refrigerator. The heat reservoir 24 is positioned at a location where latent heat is most available, such as a location where latent heat from ambient air 51 is harvested in order to maintain the fluid in the heat reservoir 24 at a warmer temperature (generally above refrigeration and freezing temperatures). FIG. 4 also shows some possible fluid pathways 36 for the fluid of the heat reservoir 24 to various applications requiring the heat output of the warming fluid. For example, FIG. 4 shows the evaporator 28 positioned adjacent the freezer compartment 18 of the refrigerator 10. A fluid pathway 36 may direct warmed fluid of the heat reservoir 24 to the coils 29 of the evaporator 28 in order to defrost said coils 29.

Additional pathways 36 may direct the warmed fluid to the refrigerator compartment door 18 and/or freezer door 20 such that the warm fluid passes through the door to limit or prevent sweating or condensation occurring on the exterior surface of the doors 18, and 20. The other pathways 36 include pumping the fluid of the heat reservoir 24 to the icemaker 26, ice bin 27, and/or warm storage compartment 32/34. As discussed above, the warm storage compartment 32 may also be known as a defrost compartment 34, and may be a separate compartment comprising a shelf in the refrigerator compartment 14 such that consumable items may be placed in the warm storage compartment 32 for accelerated defrost. Therefore, the temperature of the warm storage compartment 32 may be higher than that of the refrigerator compartment 14. As the temperature of the food in the heat reservoir 24 will generally be higher than that of the refrigerator compartment 14, the fluid may be passed adjacent or within the warm storage compartment 32 to maintain the temperature of the compartment at the preferred temperature. Shown in FIG. 4 are a plurality of flow controllers (e.g., baffles or dampers) 50 located along the fluid path(s) 36. The flow controllers 50 may be opened and closed to direct the fluid being pumped by the pump 38 from the heat reservoir 24 to the desired application. However, it should be appreciated that flow controllers 50 may not be required, and instead a separate pathway 36 be added for each individual application instead of having one pathway 36 with flow controllers along the way.

FIG. 5 is another exemplary configuration of a refrigerator 10. As shown in FIG. 5, the heat reservoir 24 may be positioned within the refrigerator cabinet 12 and adjacent a condenser 46 of the refrigeration cycle. As is known, during operation of the refrigeration cycle, the condenser 46 emits heat from the condenser coils 48. The latent heat of the condenser 46 can be captured by the fluid of the heat reservoir 24 to maintain the fluid at a temperature generally higher than that of the refrigerator compartment 14 and the freezer compartment 18. Thus, as shown in FIG. 5, the latent heat 52 of the condenser may be harvested by the heat reservoir 24 with the heat reservoir 24 positioned adjacent the condenser 46 in the refrigerator cabinet 12. A pump 38 may be positioned adjacent the heat reservoir 24 in order to pump the fluid of the heat reservoir 24 to an application requiring a heat output via a fluid pathway 36. However, it should be appreciated that the same applications may utilize this warmed fluid of the heat reservoir 24 as has been discussed above. In addition, it should be appreciated that the heat reservoir 24 can be positioned such that it receives latent heat from both the refrigeration cycle and ambient air around the exterior of the refrigerator 10. For example, a pathway may be formed in the refrigerator cabinet 12 adjacent the heat reservoir 24 such that latent heat may be harvested from the ambient air, as well as from the condenser 46 of the refrigeration cycle to provide two sources of latent heat for the heat reservoir 24.

It should be appreciated that the inclusion of a heat reservoir 24 such as that disclosed and described may be beneficial for refrigerator 10 for a number of reasons. The heat reservoir 24 can be used in place of one or more electric heaters in the refrigerator 10 such that the amount of energy consumed by the refrigerator 10 can be greatly reduced. Instead of requiring energy to power the electric heater(s) and also to pump or direct the heat to an application requiring a heat output, it's possible that the only energy required is to operate a pump to direct the warmed fluid of the heat reservoir 24 to the applications requiring the heat output. The temperature differential in the fluid being supplied from the heat reservoir 24 and returned to the heat reservoir 24 may also be used to move the fluid without requiring a pump; the result is a latent heat transfer system that requires little or even no power to operate. Therefore, the decreased energy usage of the refrigerator will also decrease the energy cost for a consumer. The size of the heat reservoir 24 can be varied according to the size of the refrigerator, as well as the amount of warm fluid required for the various applications requiring a heat output for the refrigerator 10. The size of a particular fluid loop may also be configured for the varying levels of heat output requirements for varying size refrigerators. However, as mentioned, different fluids may be used with the heat reservoir 24. It is preferred that the fluid of the heat reservoir 24 not freeze during the operation of the refrigerator such that the fluid may be reused to various applications. For example, the fluid of the heat reservoir 24 may be directed both to defrost the coils 29 of the evaporator 28 and then to limit or prevent condensation or sweating occurring at a door of the refrigerator 10. The fluid may be desired to maintain a preferred temperature to provide the heat output to the multiple applications. Thus, an anti-freeze may be preferred for use with the heat reservoir 24.

In operation, the heat reservoir, such as a heat exchanger, is positioned within, on, or at a refrigerator at a source of latent heat. As discussed, the latent heat may be from ambient air or may be from the refrigeration cycle. The heat exchanger or heat reservoir 24 harvests heat from the source of latent heat with a fluid or material contained within the heat reservoir 24. The fluid is moved to an application, such as a defrost operation, which has or requires a heat output. The heat output of the fluid is supplied to the application. The heat output is provided by the latent heat of the heat source, such as ambient air or refrigeration cycle. Thus, a low energy method of using latent heat in a refrigerator has been provided.

Figure 6:
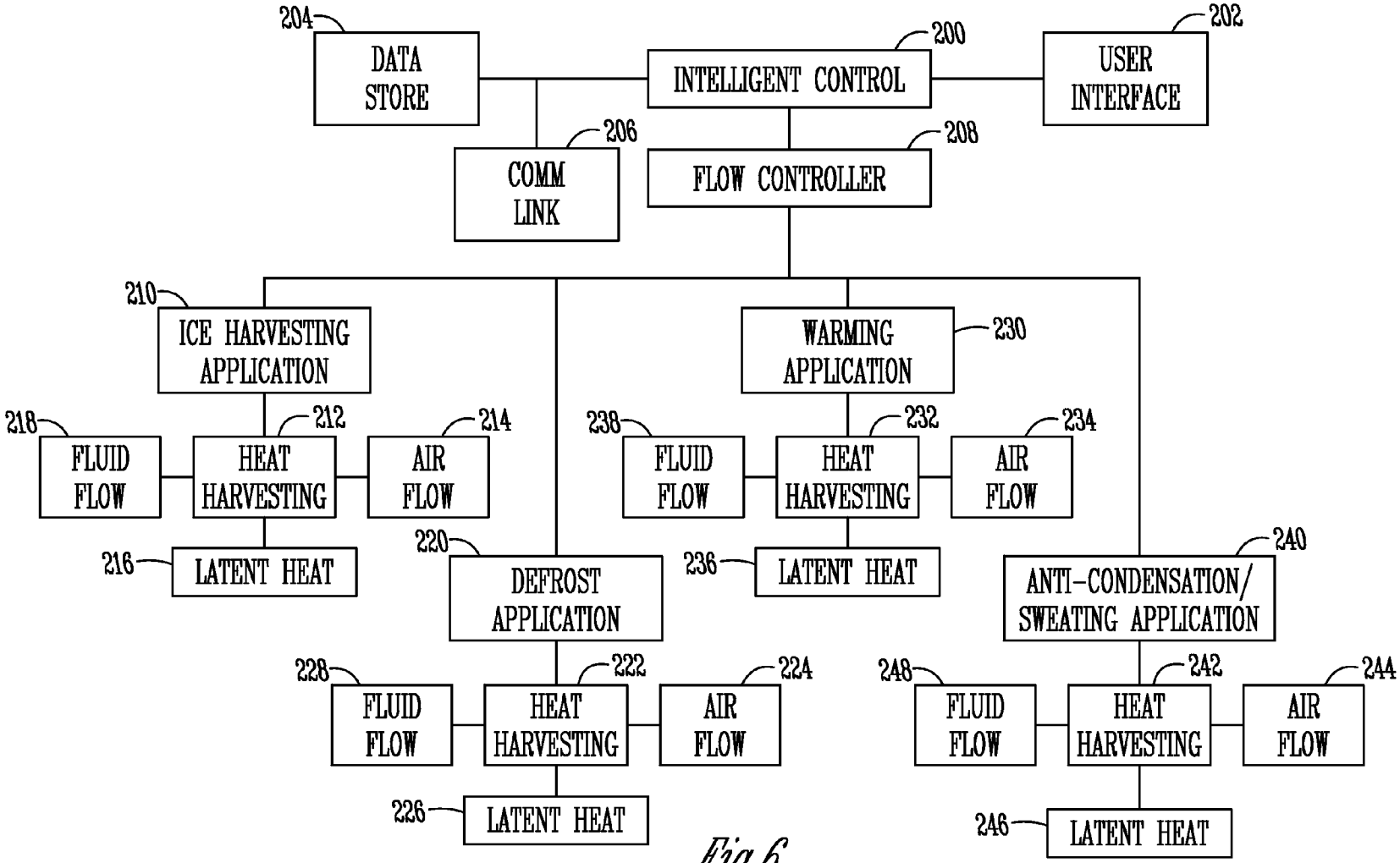
FIG. 6 is a diagram illustrating exemplary control aspects of the invention.

FIG. 6 discloses a diagram for intelligently controlling the transfer of latent heat to various applications in the refrigerator. FIG. 6 provides a flow diagram illustrating one or more control processes. To perform one or more of the aforementioned operations or applications described above, the refrigerator 10 may be configured with an intelligent control 200 such as a programmable controller. A user interface 202 in operable communication with the intelligent control 200 may be provided, such as for example, at the dispenser 22. A data store 204 for storing information associated with one or more of the processes or applications may be configured in operable communication with the intelligent control 200. A communications link 206 may be provided for exchanging information between the intelligent control 200 and one or more applications or processes, a user, a server, etc. The intelligent control 200 may also be used to control one or more flow controllers 208 for directing flow of a heat carrying medium such as air or liquid to the one or more applications or processes of the refrigerator 10. For example, in an ice harvesting application 210, the intelligent control 200 may be configured in operable communication with one or more flow controllers 208 for directing and controlling the fluid flow 218 or air flow 214 from a heat harvesting process 212. The latent heat temperature 216 of the heat harvesting process 212 may be communicated via a fluid flow 218 or air flow 214 to the ice harvesting application 210. A channel, duct, line, tubing, or other flow carrying means may be connected between a flow controller 208 and the ice harvesting application 210. The flow controller 208 may be connected in communication the heat harvesting process 212. Under operation of the intelligent control 200, a flow controller 208 may be selectively moved between open and closed positions to allow fluid flow 218 or air flow 214 from the heat harvesting process 212 to carry latent temperature heat 216 to the ice harvesting application 210. The latent heat 216 and the fluid flow 218 or air flow 214 taken from the heat harvesting process 212 may be used to warm the ice mold for the ice harvesting application 210. The ice harvesting application 210 may also be configured to dump ice upon input at the user interface 202 from a user. For example, a user may desire fresh ice or wet ice at the dispenser 22. Upon input at the user interface 202 from a user, the intelligent control 200 may operate a flow controller 208 for communicating latent heat 216 from the heat harvesting process 212 in a fluid flow 218 or air flow 214 to the ice harvesting application 210 for warming the ice mold and dispensing a fresh ice or wet ice product at the dispenser 22. The user may also be able to, through the user interface 202, control the amount of ice melt to occur in the ice harvesting application 210 before the cubes are removed from the ice mold. Information regarding the ice harvesting application 210 and information input at the user interface 202 may be stored in the data store 204 and acquired remotely using a communications link 206 (e.g., server, data transfer protocol, wired/wireless transfer). In another exemplary application, the intelligent control 200 may operate one or more flow controllers 208 for controlling a defrost application 220. The defrost application 220 may be used to defrost evaporator coils, a compartment, drawer, bin, or shelf associated with the refrigerator. The defrost application 220 may also be used to defrost a food item positioned in a compartment, drawer, bin, or on a shelf. The intelligent control 200 may be configured to control one or more flow controllers 208 for controlling a defrost application 220. For example, the intelligent control 200 may operate a flow controller 208 for communicating latent heat 226 in a fluid flow 228 or an air flow 224 from a heat harvesting process 222 to the evaporated coils for defrosting the coils. In another exemplary application, a user may provide an input at the user interface 202 for controlling the intelligent control 200. Under operation of the intelligent control 200, a flow controller 208 may be selectively moved between open and closed positions to provide latent heat 226 in a fluid flow 228 or air flow 224 from the heat harvesting process 222 to a defrost application 220, such as a defrost application for a food item at a certain location in the refrigerator. Thus, a user may be able to insert a food item into a compartment, drawer, or bin and, through the user interface 202 select a defrost application 220 for the specific type of food and location of the food. The intelligent control 200 controlling a flow controller 208 may be configured to move fluid flow 228 or air flow 224 carrying latent heat 226 from the heat harvesting process 222 to the defrost application 220 selected by the user. In another exemplary application, the intelligent control 200 may be configured in operable control of one or more flow controllers 208 for providing a warming application 230. Within the refrigerator a compartment, drawer, bin, or shelf may be configured with a warming application 230. The warming application 230 may be used to control the temperature of the compartment, drawer, bin, or shelf. The warming application 230 may also be used to control the temperature of a food item at these locations. A user may input information at the user interface 202 for controlling the temperature of these locations and a food item at the location. For example, latent heat 236 may be communicated in a fluid flow 238 or air flow 234 from the heat harvesting process to a warming application 230 by intelligently controlling a flow controller 208. In one example, a drawer or bin under operation of the intelligent control 200 may be warmed using latent heat 236 to accelerate thawing or provide a compartment, drawer, bin, or shelf having a temperature different than the surrounding temperature. In the warming application 230, the environment or the food item in the environment may be warmed to a temperature input by a user at the user interface 202. In another exemplary example, a compartment may be configured within the refrigerator compartment whereby latent heat 236 is communicated in a fluid flow 238 or air flow 234 from a heat harvesting process 232 to the compartment for warming the compartment and the food within the compartment to a temperature selected by a user at the user interface 202. The flow of latent heat 236 in the fluid flow 238 or air flow 234 may be controlled by the flow controller 208 under operation of the intelligent control 200. The communications link 206 under operation of the intelligent control 200 may be used to alert the user when the compartment has reached the desired temperature selected by the user at the user interface 202. In another exemplary application, the intelligent control 200 may be configured to control one or more flow controllers 208 under direction, for example, by inputs at a user interface 202 for controlling an anti-condensation or anti-sweating application 240. It is know that exterior panels of a refrigerator, tubing carrying a heat carrying medium (e.g. fluid or air), channels, ducts, and interior panels with frequent exposure to exterior temperatures are predisposed to collecting condensation or sweating. The intelligent control 200 may be configured to control one or more flow controllers 208 for communicating latent heat 246 using fluid flow 248 or air flow 244 from a heat harvesting process 242 to one or more anti-condensation or anti-sweating applications 240. If certain surfaces or areas within the refrigerator or outside the refrigerator are predisposed to sweating or condensation, the user may provide an input at the user interface 202 for operating the intelligent control 200 and flow controllers 208 for providing latent heat 246 from the heat harvesting process 242 to one or more anti-condensation or anti-sweating applications 240 for controlling condensation and sweating on an exterior panel, tubing, a channel, a duct, or an interior panel with frequent exposure to ambient air.

As illustrated in FIG. 6, under operation of the intelligent control 200, a user may input operational controls at the user interface 202 for controlling one or more flow controllers for distributing latent heat to specific locations within or on the exterior of a refrigerated appliance. These applications are not limited to refrigerated appliances only. The control processes provided in FIG. 6 may also be applied to other applications where the use of latent heat may replace more traditional use of electrical heaters as described above.

The preceding disclosure is not limited in its application to refrigerators only. The exemplary aspects of the disclosure may be applied to any appliance that uses heat for one or more applications, which may or may not be ordinarily supplied by an electrical heater.

The preceding disclosure is also not limited in its application to only transferring latent heat from one location to a heat output using fluid as the heat carrying medium. In another aspect, air having latent heat may be harvested from any of the aforementioned sources and communicated to any one of the aforementioned heat outputs. For example, air from the ambient may be harvested for carrying latent heat to a heat output. Latent heat in air taken off the condenser and/or condenser coils may also be harvested and communicated to a heat output for using the latent heat in the air. In such instances, air carrying latent heat may be communicated using ductwork or other air carrying means alone or in combination with a fan (not shown).

The foregoing description has been presented for purposes of illustration and description. It is not intended to be an exhaustive list or limit the invention to precise forms disclosed. It is contemplated that other alternative processes and systems obvious to those skilled in the art are considered included in the invention. The description is merely examples of embodiments. For example, the exact location of the heat exchanger or reservoir may be varied according to type of refrigerator used and heat requirements for the refrigerator. In addition, the configuration of the fluid in the heat reservoir may be varied according to the requirements of the refrigerator. In addition, the methods and system for supplying the warmed fluid of the heat reservoir, which has been warmed by a latent heat source, may be varied as well. For example, one or more pathways may be provided between the heat reservoir and application requiring a heat output. As mentioned, the location of the heat reservoir or heat exchanger may vary. For example, it is preferred that the heat reservoir or heat exchanger be positioned to harvest the latent heat of ambient air, refrigeration cycle, or other source in the most efficient manner as possible. It is understood that any other modifications, substitutions, and/or additions may be made, which are within the intended spirit and scope of the invention. From the foregoing, it can be seen that the disclosure accomplishes at least all of the stated objectives.

What is claimed is:

1. A refrigerator comprising:

a cabinet body of one or more exterior walls separating interior space of the refrigerator from ambient air and a door that provides access to the cabinet body;

a heat reservoir positioned on the one or more exterior walls of the cabinet body at a source of latent heat within an indoor environment, the heat reservoir harvesting heat from the indoor environment's source of latent heat;

an application having a heat output, the application at a location generally remote from the heat reservoir;

a liquid pathway disposed in at least a portion of the one or more exterior cabinet walls between the heat reservoir and the application for supplying the heat output at the application from the heat reservoir;

a pump in operable communication with the liquid pathway for moving liquid through the liquid pathway between the heat reservoir and the application.

2. The refrigerator of claim 1 wherein the heat reservoir comprises a heat storage battery.

3. The refrigerator of claim 1 wherein the heat reservoir includes a heat exchanger.

4. The refrigerator of claim 1 wherein the heat reservoir is positioned on an exterior surface of the cabinet body for harvesting heat from ambient air.

5. The refrigerator of claim 1 wherein the source of latent heat comprises ambient air.

6. The refrigerator of claim 1 wherein the source of latent heat comprises a condenser coil.

7. The refrigerator of claim 1 wherein the application comprises;

a. an icemaker having an ice mold with the heat output for harvesting ice from the ice mold supplied from the heat reservoir;

b. a defrost operation with the heat output for defrosting supplied from the heat reservoir;

c. an anti-condensation operation with the heat output supplied from the heat reservoir;

d. an anti-freezing operation with the heat output supplied from the heat reservoir;

e. a storage space having a warming operation with heat output supplied from the heat reservoir.

8. A refrigerator comprising:

a cabinet body and a door that provides access to the cabinet body;

a refrigerator compartment and a freezer compartment disposed within the cabinet body;

an application having a heat output associated with an operation of the refrigerator;

a liquid pathway positioned at a source of latent heat, the liquid pathway between the source of latent heat and the application for supplying the heat output for the operation from the source of latent heat, at least a portion of the liquid pathway is disposed in the door to minimize condensation;

a pump in operable communication with the liquid pathway for moving the latent heat in liquid through the liquid pathway between the source of latent heat and the application.

9. The refrigerator of claim 8 further comprising a heat exchanger at the source of latent heat, the heat exchanger includes a liquid head carrier for moving heat in the liquid heat carrier from the source of latent heat to the application.

10. The refrigerator of claim 8 further comprising a liquid heat reservoir at the source of latent heat, the heat reservoir for harvesting and storing heat from the source of latent heat.

11. The refrigerator of claim 10 further comprising a liquid supply line connected between the liquid heat reservoir and the application for supplying the heat output for the operation from the liquid heat reservoir.

12. The refrigerator of claim 9 wherein the heat exchanger is positioned on an exterior surface of the cabinet body for harvesting heat from ambient air around the refrigerator.

13. The refrigerator of claim 9 wherein the heat exchanger is positioned proximate a condensing coil within the cabinet body.

14. The refrigerator of claim 8 wherein the application comprises an icemaker having an ice mold, wherein the heat output for harvesting ice from the ice mold is supplied from the source of latent heat.

15. A method for using latent heat in a refrigerator, comprising:

providing a cabinet body with a refrigerator compartment and freezer compartment, one or more doors providing access to the cabinet body, and a heat reservoir disposed on the cabinet body from ambient air surrounding the cabinet body;

positioning the cabinet body with the heat reservoir indoors where there is a source of latent heat from ambient air surrounding the cabinet body;

harvesting heat from the source of latent heat surrounding the cabinet body with a liquid;

moving the liquid through the cabinet body to an application having a heat output;

supplying the heat output at the application using the latent heat in the liquid.

16. The method of claim 15 further comprising pumping the liquid from a heat exchanger to the application through a liquid supply line.

17. The method of claim 15 wherein the heat reservoir has a body of the liquid for storing heat from the source of latent heat in ambient air surrounding the cabinet body.

18. The method of claim 15 further comprising harvesting latent heat from:

a. an ambient source;

b. a refrigeration cycle.

19. The method of claim 15 further comprising melting at least partially a batch of ice housed in an ice bin using the latent heat.

20. The method of claim 15 further comprising warming an ice mold in an icemaker using the latent heat for harvesting ice from the icemaker.

* * * * *